United States Patent [19]

Chelius

[11] Patent Number: 4,720,123

[45] Date of Patent: Jan. 19, 1988

[54] CUSTOMIZED CALENDAR

[75] Inventor: Robert G. Chelius, Palatine, Ill.

[73] Assignee: Colorforms Image Center, Inc., Glenview, Ill.

[21] Appl. No.: 913,062

[22] Filed: Sep. 29, 1986

[51] Int. Cl.[4] ..... B42D 15/00; B42D 15/02; G08D 3/00

[52] U.S. Cl. ..... 283/2; D19/22; 283/3; 40/107

[58] Field of Search ..... 283/2, 3, 4; 40/107; D19/20, 21, 22, 23, 24, 25, 19

[56] References Cited

U.S. PATENT DOCUMENTS

| | | | |
|---|---|---|---|
| D. 138,713 | 9/1944 | Klein et al. | D19/22 |
| D. 142,265 | 8/1945 | Stanton | D19/22 |
| 553,996 | 2/1896 | Moore | 283/2 |
| 1,207,987 | 12/1916 | Oehler . | |
| 1,443,520 | 1/1923 | Beckett . | |
| 1,528,633 | 3/1925 | Ringler | 283/2 |
| 1,597,280 | 8/1926 | Machauer . | |
| 1,601,018 | 9/1924 | Haynes | 283/2 |
| 2,003,142 | 5/1935 | Fisher | 40/107 |
| 2,328,206 | 8/1943 | Fowler | 40/107 |
| 2,831,278 | 4/1958 | Myers | 40/107 |
| 3,964,195 | 6/1976 | Jordan | 40/107 |
| 4,178,019 | 12/1979 | Gedzelman | 40/107 |
| 4,218,077 | 8/1980 | Ember | 283/2 |

*Primary Examiner*—E. R. Kazenske
*Assistant Examiner*—Paul M. Heyrana, Sr.

[57] ABSTRACT

A customized, i.e., personalized, calendar having a plurality of surface sections is disclosed in which name information indicia is presented in one section, important date information indicia is in another section, birthdate information indicia is contained in a third section, and monthly calendar information indicia is in a fourth section. The calendar as customized can be readily printed with a computer-driven printer system. Another embodiment includes, besides the customized calendar, a personalized transmittal letter section and a personalized mailing label section.

8 Claims, 3 Drawing Figures

CUSTOMIZED CALENDAR

BACKGROUND OF THE INVENTION

The present invention relates to planar-type event calendars, and more specifically to a traditional annual calendar having customized name and birthdate information contained therein.

FIELD OF THE INVENTION

Numerous event calendars have been utilized in the past for, besides presenting day and date information, providing a method of organizing specific event information, such as for baseball games, theatre events, museum and gallery events, and so forth.

The present customized calendar invention includes not only the ordinary day and date information in the usual monthly format, but additionally includes customized name and birthdate information for a specific individual, or for a friend or relative of that individual. Once the name and birthdate information is obtained for a given person or persons, the customized calendar of the present invention can be prepared by use of a computer-driven printer system in which the customary monthly day and date information is presented in one section or sections of the calendar, important date information including birthdate information is presented in another section or sections of the calendar, and the specific individual's name is included in yet another section on the calendar.

Therefore, it is an object of the present invention to provide a planar customized calendar which is personalized to include specific name, birthdate, important date, and monthly calendar information in separate sections.

It is a further object of the present invention to highlight the birthdate of a specific individual on a customized calendar.

It is a still further object of the present invention to include a specific individual's birthdate within a list of commonly recognized important dates on a customized calendar.

The means by which the foregoing and other objects of the present invention are accomplished and the manner of their accomplishment will be readily understood from the following specification upon reference to the accompanying drawings, in which:

FIG. 1 depicts the customized calendar of the present invention including transmittal letter and mailing label components; and FIGS. 2 and 3 are views of modified versions of the customized calendar of the present invention.

DESCRIPTION OF THE PREFERRED EMBODIMENT

Figure 1:
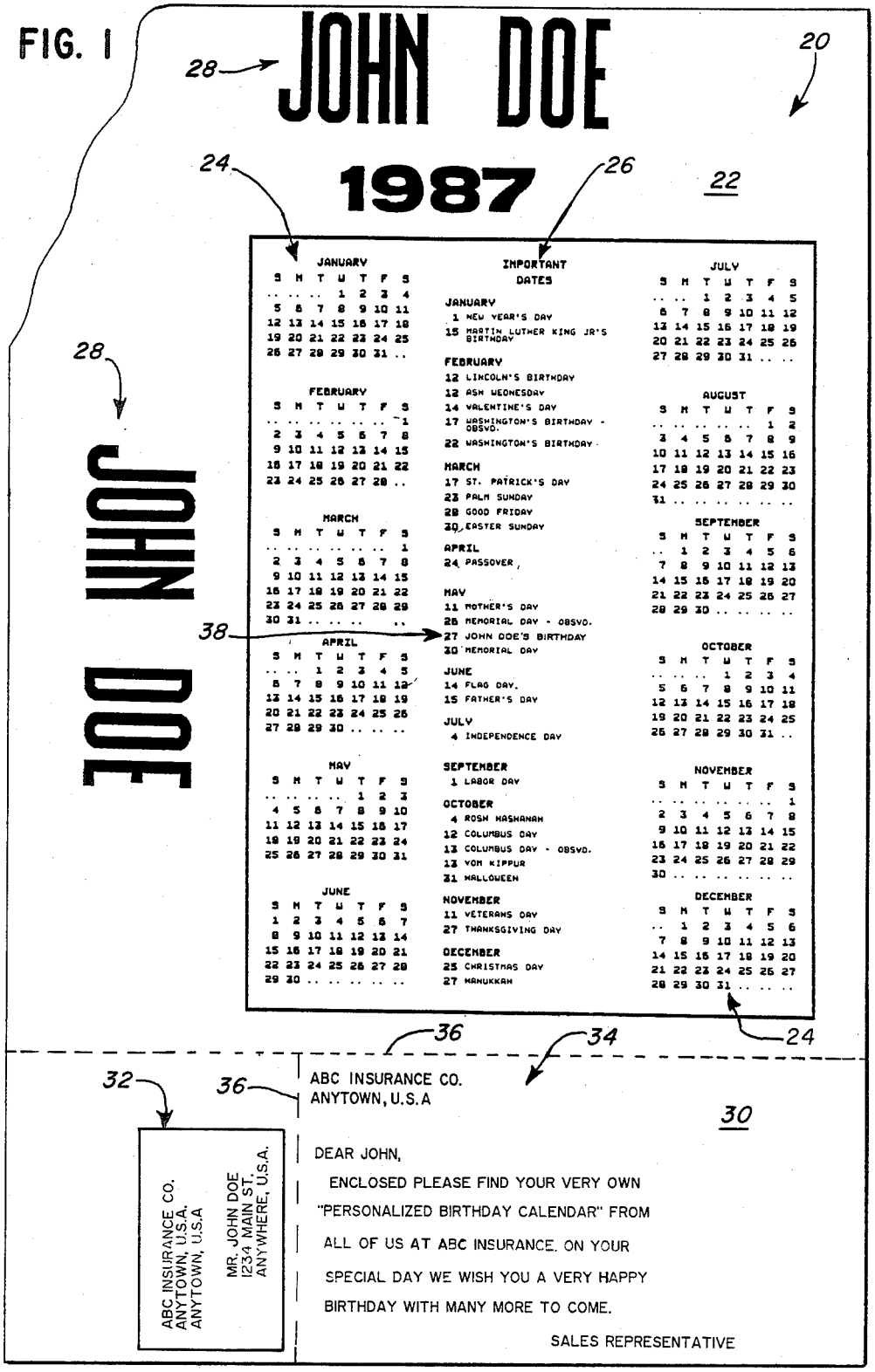

Having reference to the drawings, wherein like reference numerals indicate corresponding elements, there is shown in FIG. 1 an illustration of the customized calendar of the present invention, generally denoted by reference numeral 20. The preferred format for calendar 20 is of an annual form. That is, the separate months of January through December are presented in consecutive fashion on one planar sheet 22. The sheet 22 comprises several surface sections having information indicia in each, namely two monthly calendar information sections 24, important date information section 26, and two name information sections 28. It will be noted that sections 24 and 28 could be presented as only one section each, rather than as two.

Additionally, the planar sheet 22 includes a removable strip section 30 comprising a mailing label section 32 and a transmittal letter or so-called lift note section 34. Pre-punched serration lines 36 are formed in the planar sheet 22 so as to permit sections 32 and 34 to be tearably removed from the customized calendar 20, as explained later herein.

The important date information section 26 includes, in chronological order throughout any given year, various commonly and nationally recognized holidays and events, such as New Year's Day, St. Patrick's Day, Yom Kippur, and so forth. Additionally, and as a distinct part of the personalization of the customized calendar of the present invention, a listing of the actual birthdate or wedding anniversary date for a specific individual, depicted in FIG. 1 by reference numeral 38, is included in the important date column 26. By way of example, in FIG. 1, the birthday of John Doe, which falls on May 27, is referenced by numeral 38.

Further, John Doe's actual name is set forth in the name information sections 28, which in the preferred embodiment run horizontally across the top of the calendar 20 and vertically down its left side. In this manner, the customized calendar 20 is a unique, personalized calendar for John Doe. That is, once John Doe's (or any specific individual's) name and birthdate are identified, a computer-driven printing system (not shown) can generate the customized calendar 20, thereby personalizing the same with his name in section 28, and his actual birthday in important date information section 26.

Further yet, John Doe's actual name is included in the mailing label section 32 when the calendar 20 is being custom printed. Additionally, John Doe's name is included in the salutation of the transmittal letter section 34 so as to personalize even that portion of customized calendar 20.

It will be understood that in the preferred embodiment, the computer paper used for custom printing calendar 20 can have pre-printed thereon the return address of a given individual or company (for example, the fictitious ABC Insurance Co. in FIG. 1) for mailing label section 32 and transmittal latter section 34. Further, such computer paper can include the serration lines 36 and have moistenable glue applied to a portion of the rear side of such paper corresponding to the size of mailing label section 32. Thus, when the letter is torn off along serration lines 36, the label 32 can be moistened and applied to a mailing envelope (not shown), included in which are the transmittal letter section 34 and customized calendar 20, for mailing to John Doe, or other selected recipient.

In known fashion and as desired, additional advertising copy of the sender of customized calendar 20 can be included thereon, such as along the border areas of calendar portion 20, or of the transmittal letter section 34 (the text of which is included in FIG. 1 only for illustrative purposes).

Figure 2:
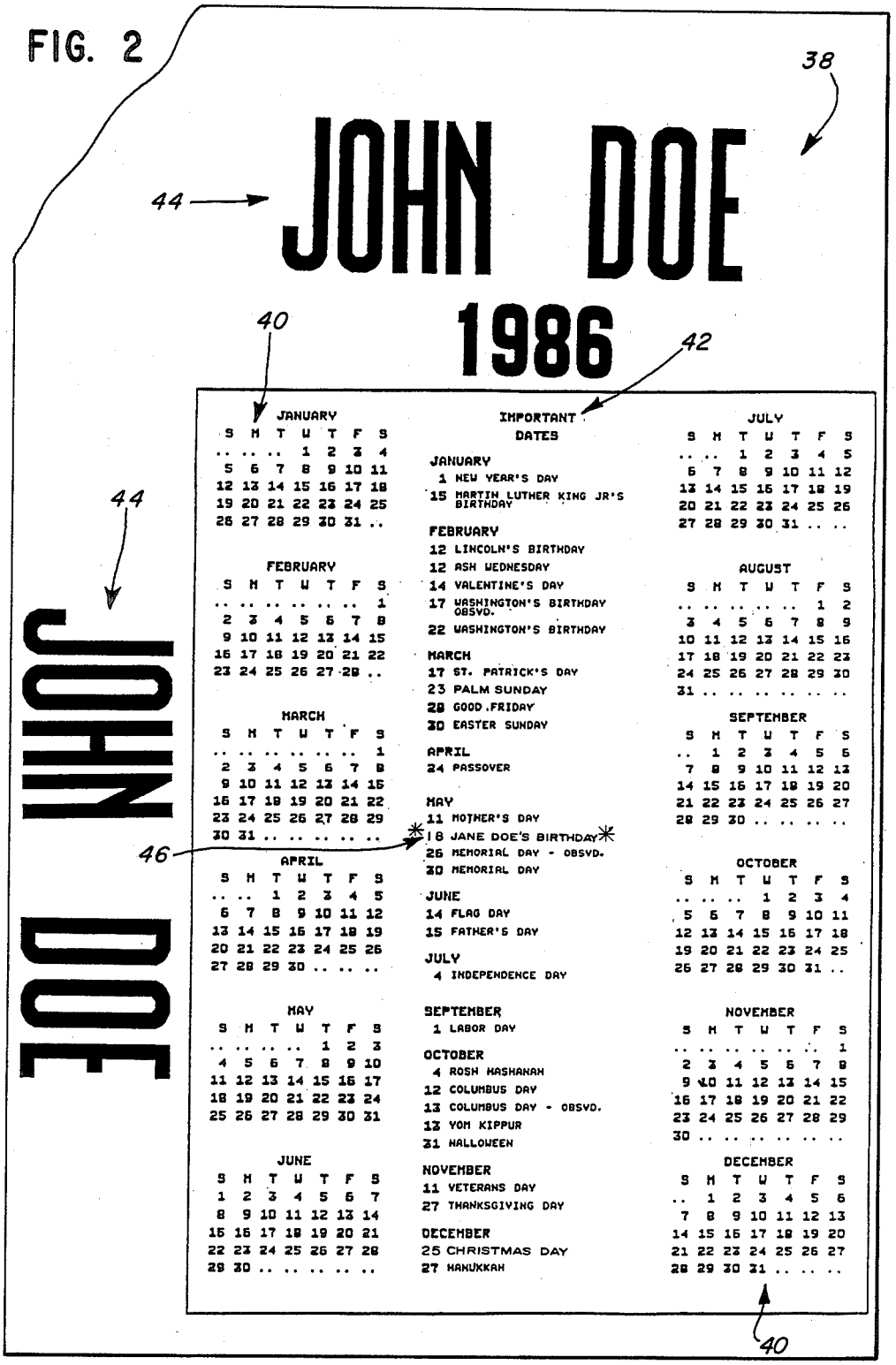

Another embodiment of the present invention is depicted in FIG. 2, in which a slightly modified customized calendar 38 includes calendar sections 40, important date section 42, and name information section 44. It will be noted in calendar 38 that, while the calendar is personalized by name for John Doe, it is also customized by birthdate for a different individual, for example, the May 18 birthdate of his wife, Jane Doe. Additionally, if desired, a highlighting element such as asterisk 46 can be utilized adjacent his wife's birthdate to highlight the same.

Figure 3:
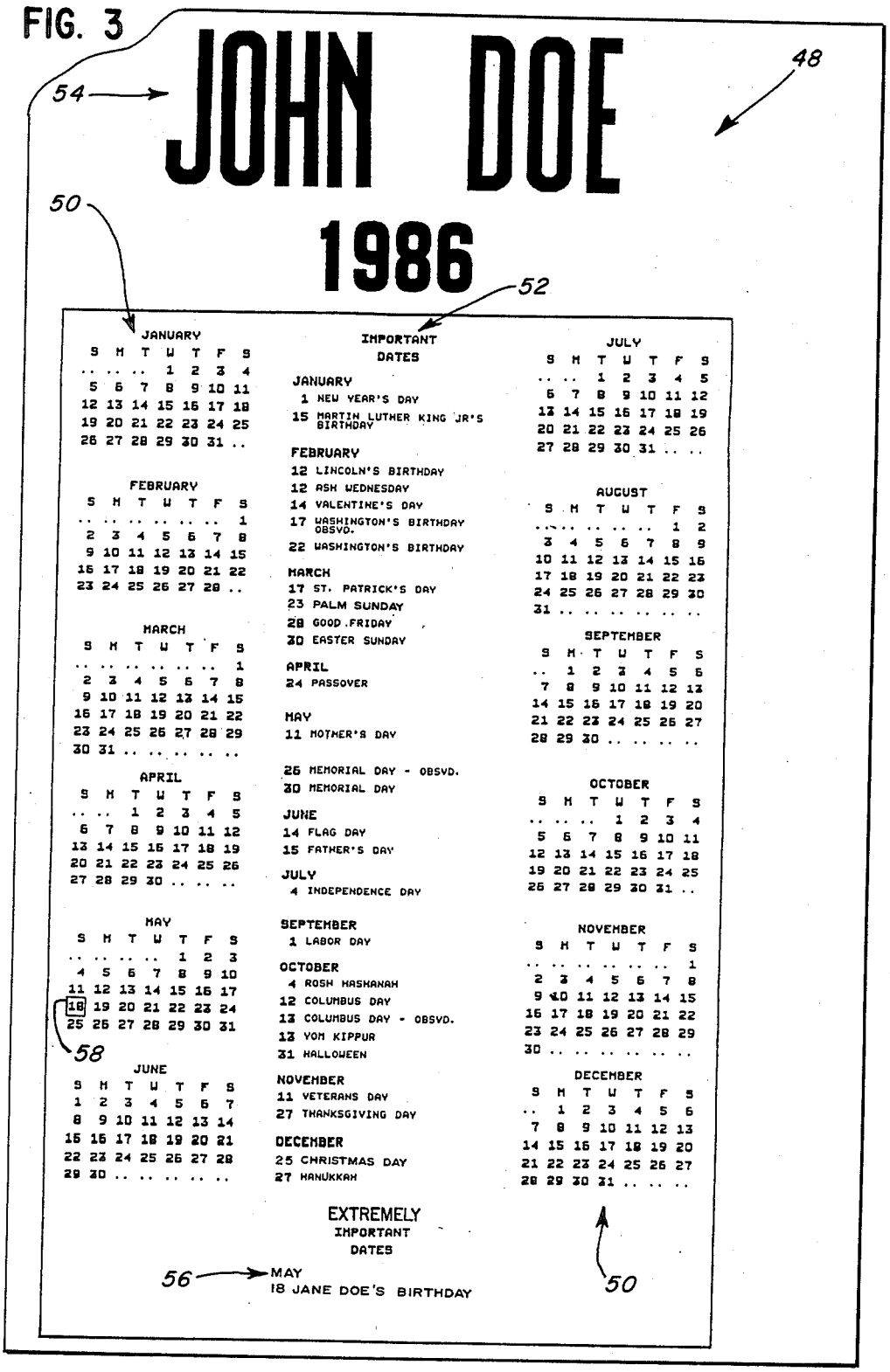

A yet further modified embodiment is depicted in FIG. 3, in which a customized calendar 48 has calendar sections 50, important date section 52, a single name section 54, and an additional important date section 56, entitled "Extremely Important Dates". Included in section 56 is the May 18 birthdate of John Doe's wife, Jane Doe. Additionally, as depicted by reference numeral 58, a separate highlighting element or outline box can be utilized around the date of May 18 (the personalized birthdate for this particular illustrative calendar 48) in the May monthly calendar area of calendar information section 50.

Other well-known shapes besides box 58 could be utilized to highlight any particular birthdate. Also, alternate ways of highlighting the customized birthdate or name information in calendar sections 24 and important date information section 26 is to utilize bold face or double struck printing, as compared to plain face printing, or use a contrasting color.

It will be understood that, in actual use, the personalized birthdate information for the custom calendar of the present invention could be for a relative, wife, sibling, parent, grandparent, and so forth, of the person whose name appears in the name information section 28. Also, two or more different personalized birthdate lines could be included in the important date section 26, as desired. For example, all the children of a specific individual for whom the calendar is customized in name section 28 could have their birthdates included in important date section 26.

Thus, there is disclosed a customized, computer-printed calendar for any given year which is personalized to include a specific individual's name and relevant specific birthdate or similar information in calendar format. Such personalized calendars can be used as premiums for insurance companies, real estate companies, and other companies who utilize custom-printed advertising items for mail solicitation purposes and which companies have access to an individual's name and birthdate.

From the foregoing, it is believed that those skilled in the art will readily appreciate the unique features and advantages of the present invention over previous types of special event and date calendars. Further, it is to be understood that while the present invention has been described in relation to particular preferred and alternate embodiments as set forth in the accompanying drawings and as above described, the same nevertheless is susceptible to change, variation and substitution for equivalents without departure from the spirit and scope of this invention. It is therefore intended that the present invention be unrestricted by the foregoing description and drawings, except as may appear in the following appended claims.

I claim:

1. A customized calendar comprising at least one planar sheet having a plurality of surface sections formed by the printing of information thereon, and including important date information indicia printed thereon in one section, name information indicia relating to a specific person printed thereon in at least a second section, birthdate information indicia printed thereon in a third section, and monthly calendar information indicia printed thereon in at least a fourth section.

2. The invention of claim 1, wherein the birthdate information indicia is included within said section of important date information indicia.

3. The invention of claim 1, wherein the birthdate information indicia relates to the birthdate of said specific person.

4. The invention of claim 1, wherein said important date information indicia is listed in a columnar format.

5. The invention of claim 1, wherein said important date information indicia is presented with said monthly calendar information indicia sections.

6. The invention of claim 1, and including transmittal letter and mailing label information indicia printed thereon in at least a fifth section, and separation means separating said fifth section from the remaining said sections, whereby said transmittal letter and mailing label information indicia section can be segregated from the customized calendar to permit forwarding of the latter to its intended recipient.

7. The invention of claim 1, and highlighting element means associated with said birthdate information indicia so as to draw attention to the latter.

8. The invention of claim 1, wherein the printing of information on the customized calendar is provided by a computer-driven printing system.

* * * * *